US005450780A

United States Patent [19]

Hoshino

[11] Patent Number: 5,450,780

[45] Date of Patent: Sep. 19, 1995

[54] HOOP WITH LUG BOLT HOLDER FOR A BASS DRUM

[75] Inventor: Yoshiki Hoshino, Aichi, Japan

[73] Assignee: Hoshino Gakki Co., Ltd., Japan

[21] Appl. No.: 214,780

[22] Filed: Mar. 16, 1994

[30] Foreign Application Priority Data

Oct. 20, 1993 [JP] Japan ..... 5-061431 U

[51] Int. Cl.[6] ..... G10D 13/02

[52] U.S. Cl. ..... 84/413; 84/411 R

[58] Field of Search ..... 84/413, 422.1, 422.2, 84/411 R, 412, 419, 420

[56] References Cited

U.S. PATENT DOCUMENTS 3,635,119 1/1972 Thompson ..... 84/411 R
4,211,144 7/1980 May ..... 84/411 A
4,829,874 5/1989 Hoshino ..... 84/421
5,349,891 9/1994 Belli ..... 84/411 R

*Primary Examiner*—Michael L. Gellner
*Assistant Examiner*—Cossandra C. Spyrou
*Attorney, Agent, or Firm*—Ostrolenk, Faber, Gerb & Soffen

[57] ABSTRACT

A drum hoop with integral lug bolt receivers defined around the hoop. Each lug bolt receiver including a through hole through which a lug bolt is passed to a respective lug on the periphery of the drum body. Because the lug bolt receivers are integrated with the hoop, the receivers are retained and do not separate from the drum hoop when the lug bolts are loosened for enabling replacement of a drum head held by the drum hoop. In addition, the interior surface of the drum hoop is tapered toward the outer surface in a direction from the outer edge toward the inner edge of the hoop to facilitate attachment of a clamp to the drum hoop.

4 Claims, 6 Drawing Sheets

HOOP WITH LUG BOLT HOLDER FOR A BASS DRUM

BACKGROUND OF THE INVENTION

The present invention relates to a drum hoop for a bass drum and more particularly to means holding the drum lug bolts to the drum hoop.

In a conventional bass drum 20, as shown in FIGS. 5 and 6, an annular drum hoop 22 is provided at one end of the drum body 21 and the drum head 23 is fixed over the open end of the drum body by means of the hoop 22.

A drum pedal 30 is conventionally connected to a conventional beater 31 for beating the supported drum head at the end of the body opposite the hoop 22. The bass drum has a support leg 32.

The hoop 22 has the shape of a cylinder with a diameter which is slightly larger than the diameter of the drum body 21. The hoop is installed on the drum body 21 and presses on the bead around the periphery of the drum head 23. The hoop 22 is fixed to the drum body 21 by a plurality of lug bolts 24 which are screwed into and tightened in threaded holes in respective lugs 26 which are arrayed around the drum body 21. The tension on the drum head 23 is adjusted by adjusting the tightening length of the various lug bolts 24.

In FIG. 6, there is a lug bolt receiver 25 comprising a bolt passage 27 and an engaging part 28. The lug bolt receiver 25 is installed on the hoop 22 through its engaging part 28 engaging the edge of the hoop 22. If the lug bolt 24 is removed from the lug 26, as when the drum head 23 is to be changed, the lug bolt receiver 25 may drop off the hoop 22 in some cases. It has been difficult to exchange the drum head because that requires engaging the lug bolt receiver 25 with the hoop 22 by fitting it to the position of the lug 26 on the drum body 21, followed by the tightening of the lug bolt 24.

Because the lug bolt receiver 25 is made of metal, moreover, there has been a problem that the hoop 22 tends to be damaged, and its outside appearance is marred especially when the hoop 22 is made of wood, by the placement of the bolt receiver on the hoop or even by the tightening of the lug bolt 24.

SUMMARY OF THE INVENTION

The invention is designed to solve the above problem with known lug bolt receivers. It provides a hoop for the bass drum, which the lug bolt receiver will not fall off when the hoop is attached or detached.

A hoop for a bass drum, which is to be attached to the lugs of the bass drum by means of lug bolts, includes lug bolt receivers formed on the outer peripheral surface of the hoop and the lug bolt receivers have respective through holes for the lug bolts.

Other objects and features of the invention are explained below with reference to the drawings.

DESCRIPTION OF THE PREFERRED EMBODIMENT

Figure 1:
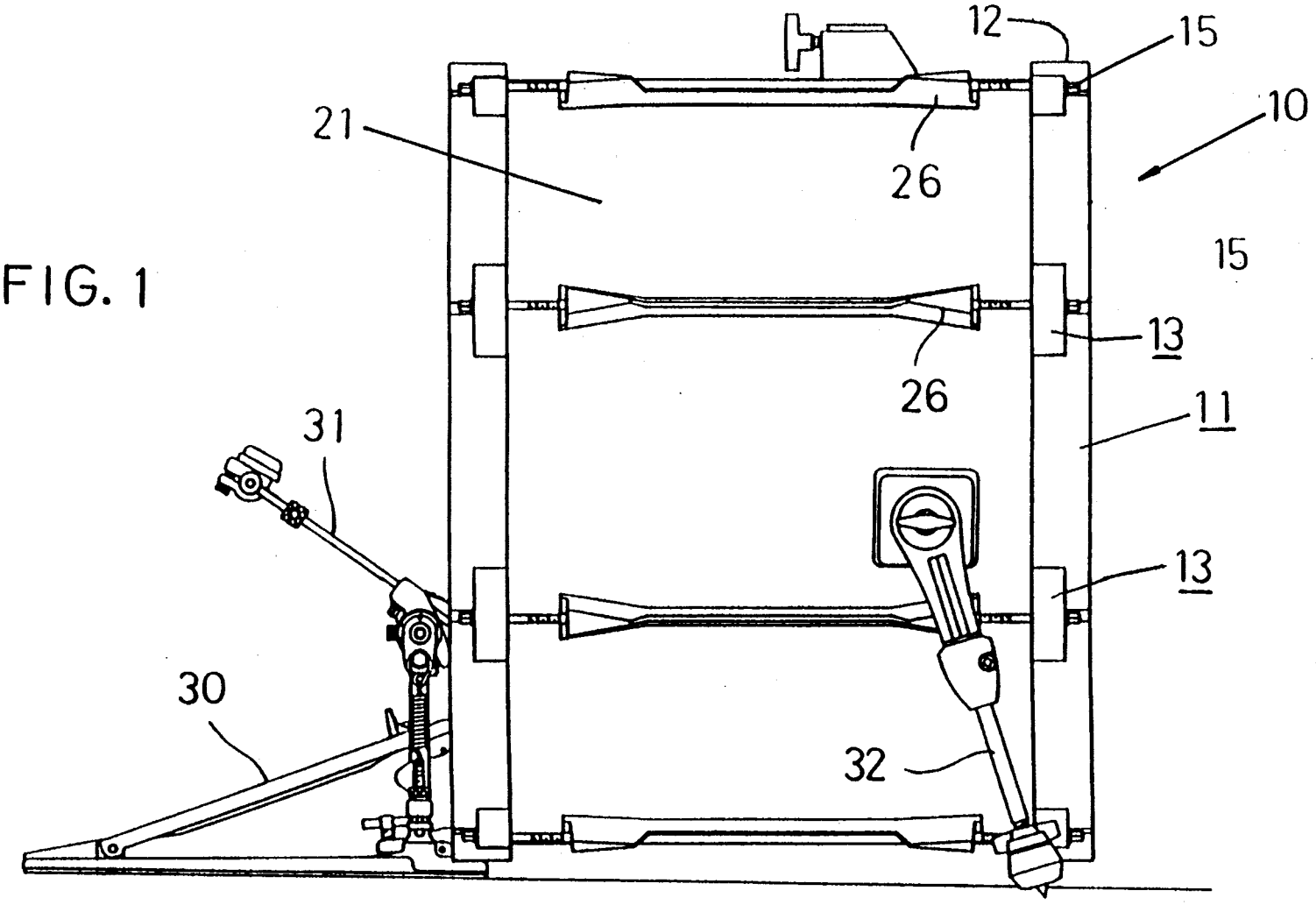
FIG. 1 is a side view of a bass drum incorporating the hoop for a bass drum according to the invention.
Figure 5:
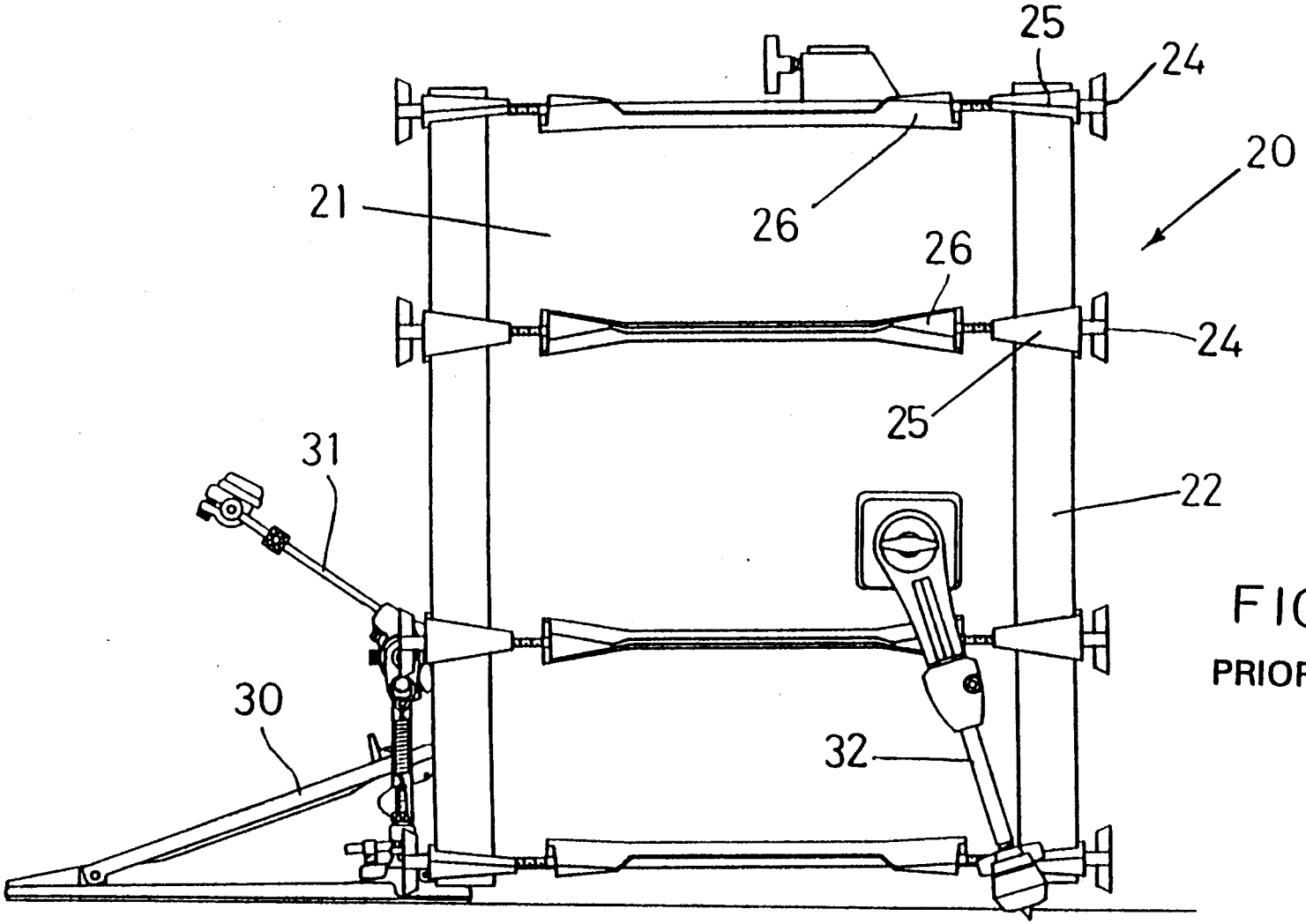
FIG. 5 PRIOR ART
FIG. 5 is a side view showing an example of a conventional bass drum.
Figure 6:
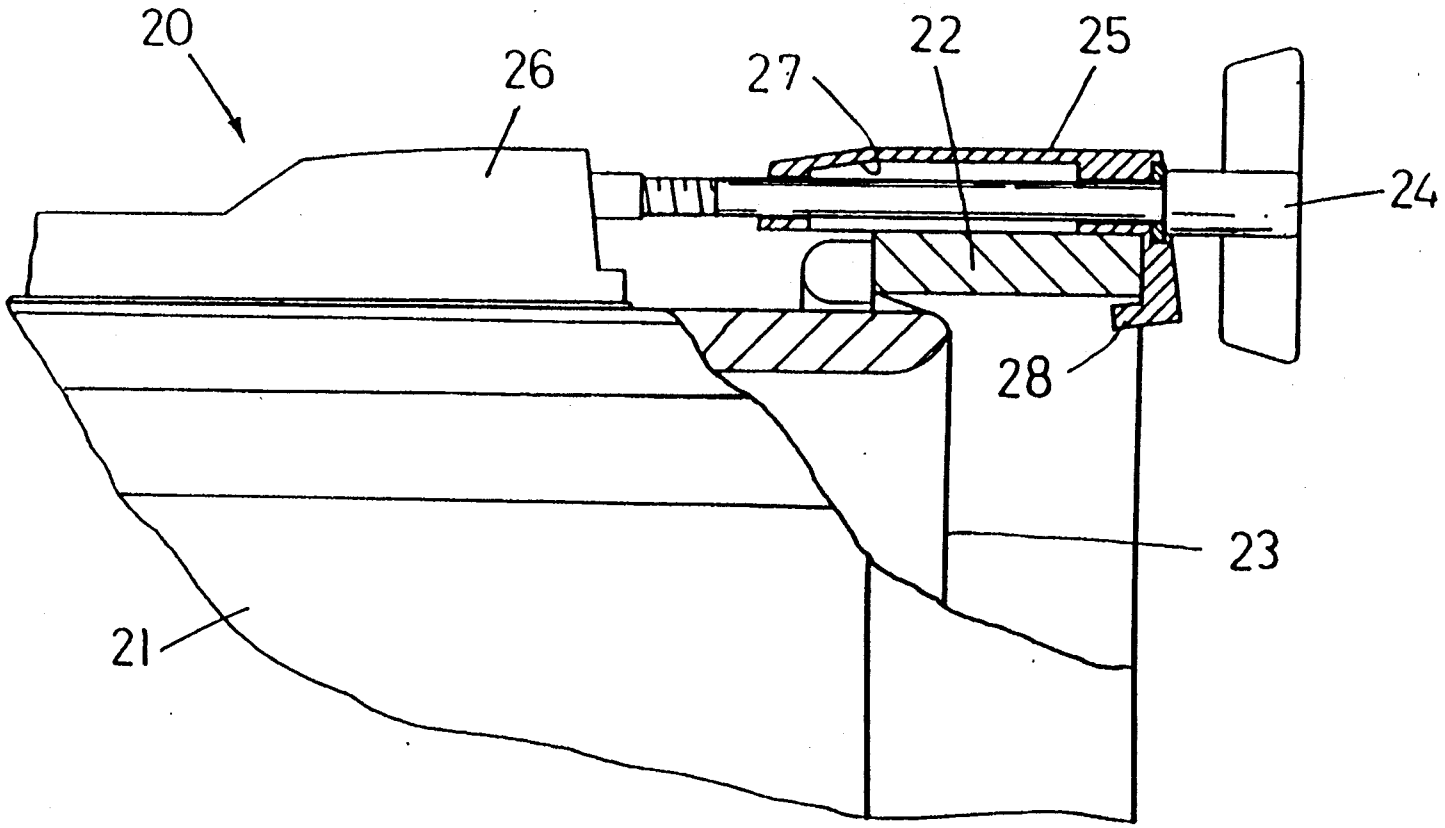
FIG. 6 PRIOR ART
FIG. 6 is an expanded cross section showing the essential part of the drum of FIG. 5.

FIG. 1 shows a bass drum in which the hoop for the bass drum according to the invention has been installed. Those elements which are the same as in FIGS. 5 and 6 are indicated by the same numbers.

The hoop 10 for the bass drum comprises an annular hoop 11 and a plurality of lug bolt receivers 13 arrayed around the external periphery of and integral on the hoop 11. The hoop 11 has an inner diameter which is slightly larger than the outer diameter of the drum body 21 for enabling installation of the hoop over one end region of the drum body 21.

Figure 2:
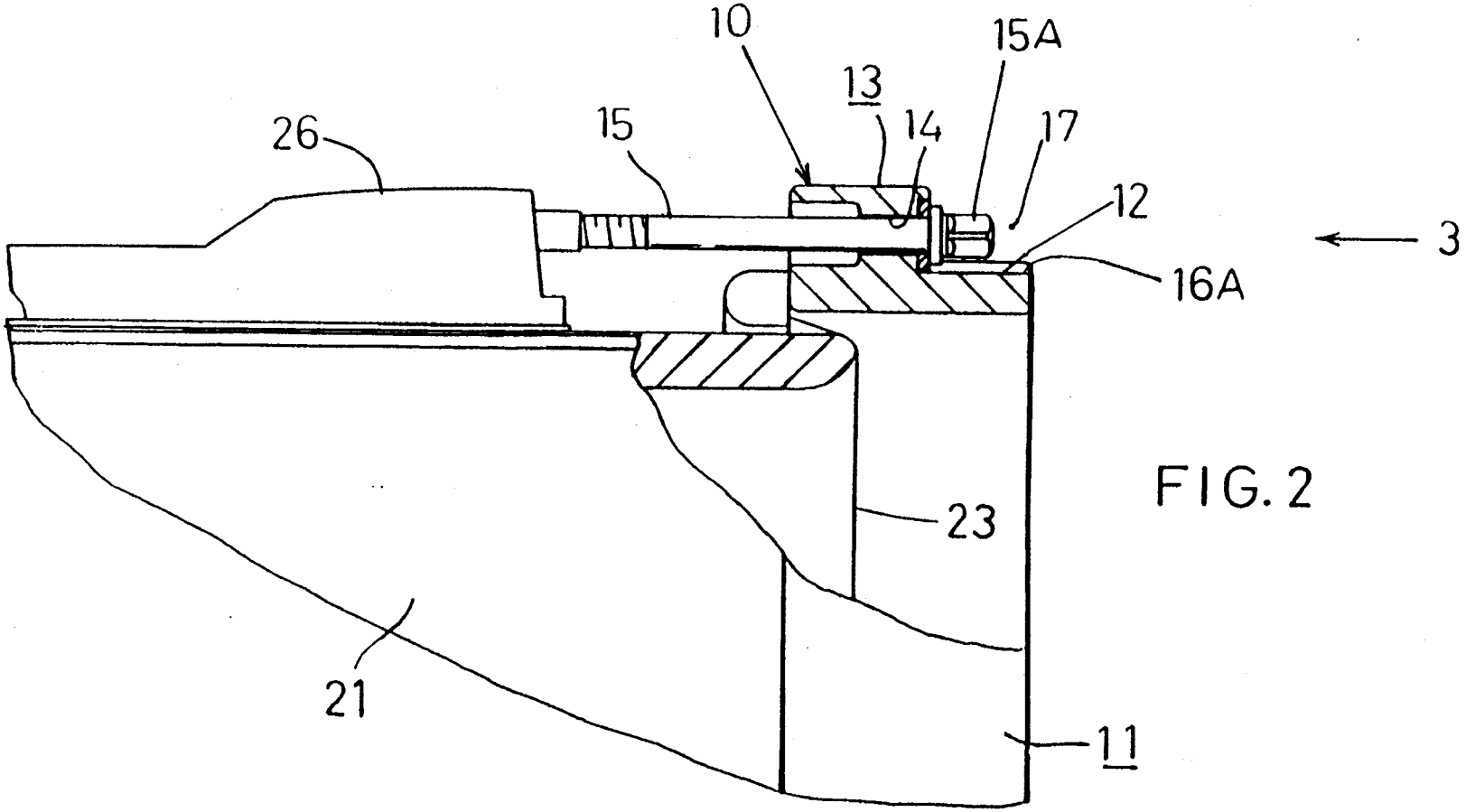
FIG. 2 is an expanded view of an essential part of the hoop.

The lug bolt receivers 13 are provided integrally on the hoop at approximately equal spacing on the outer peripheral surface 12 of the hoop 11. In FIG. 2, a lug bolt insertion through hole 14 is shown extending along the axial width direction of the hoop 11 in the lug bolt receiver 13.

The bass drum hoop 10 tightly secures the drum head 23 to the drum body 21 as a lug bolt 15 is inserted into the lug bolt insertion hole 14 and is screwed into the threaded hole in the lug 26 on the drum body 21.

Attachment or detachment of the hoop 10 for the bass drum may be carried out speedily and accurately, for example in exchanging the drum head 23, without the position of the lug bolt receivers 13 being deviated from their locations on the hoop 11 and without their dropping off.

Figure 3:
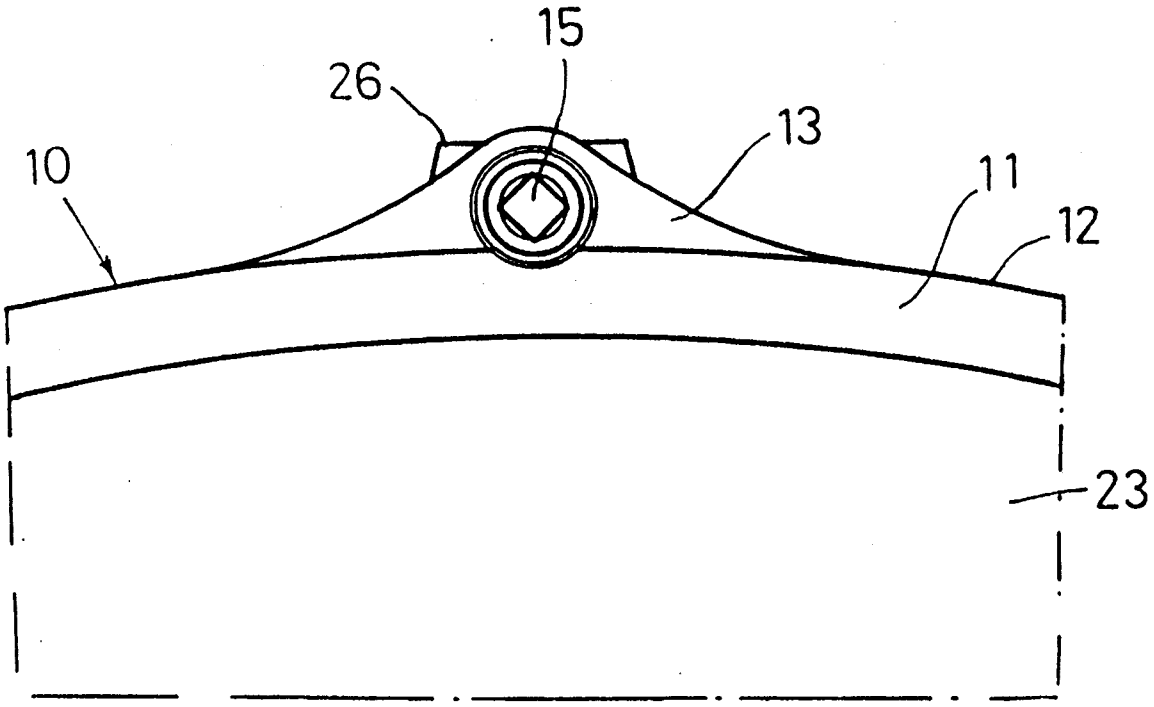
FIG. 3 shows the part illustrated in FIG. 2, viewed from the direction indicated by 3 in FIG. 2.

If a T-shaped bolt, as shown in FIG. 6, is used as the lug bolt 15, the lug bolt may be bent due to vibrations or shocks received during transportation. It is therefore desirable to use an angular head bolt, as shown in FIG. 3, as the lug bolt 15. Further, the lug bolt receiver 13 projects slightly inside the outer edge 16A of the outer peripheral surface 12 of the hoop 11, defining an empty space 17 between the lug bolt receiver 13 and the outer edge 16A. The space 17 accommodates the head 15A of the lug bolt 15. It is possible to prevent possible protrusion of the head of the bolt outside of the outer edge of the hoop, protecting the bolt from being bent by a shock, etc.

Figure 4:
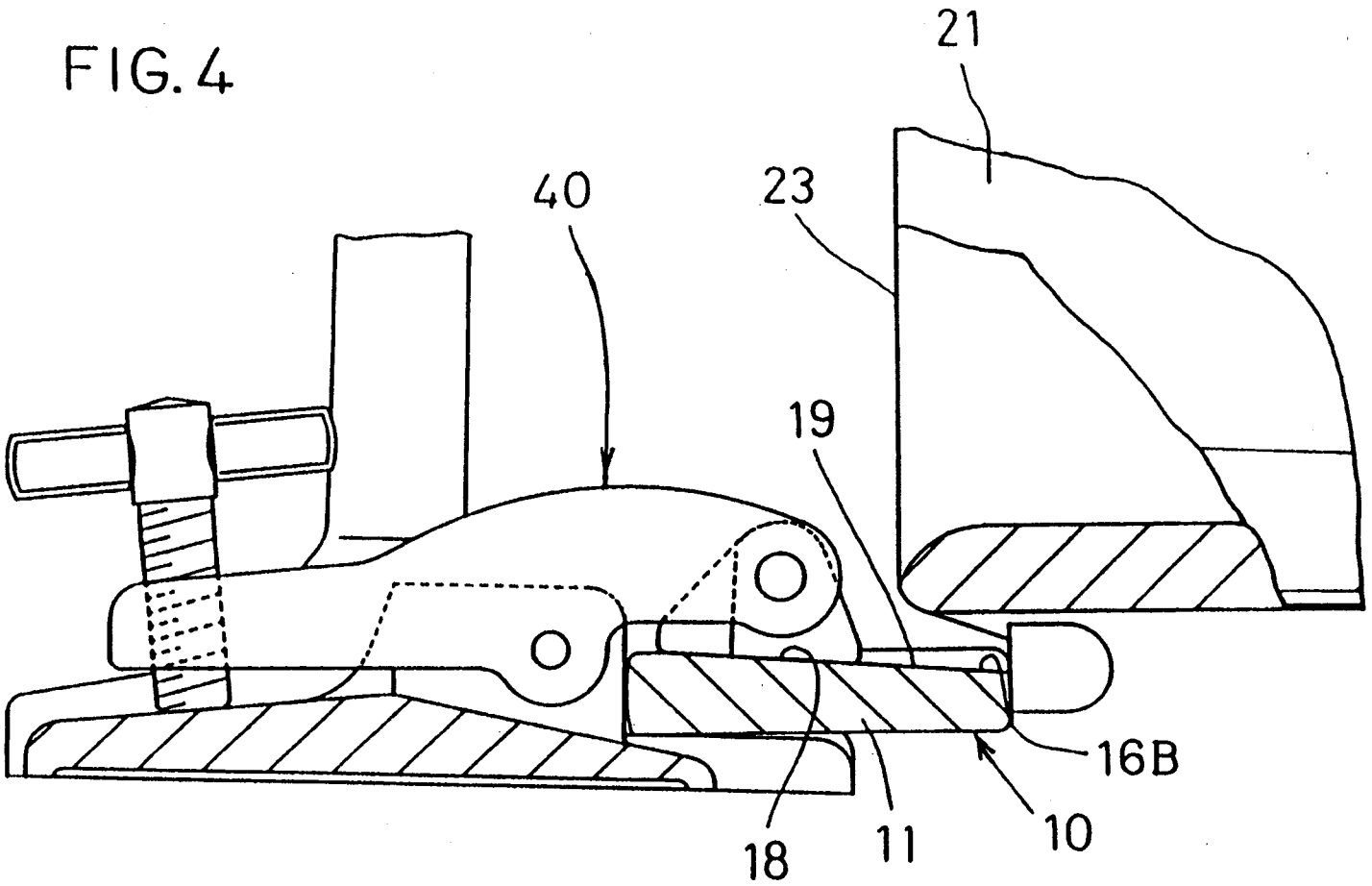
FIG. 4 is a cross section showing an example of the tapered surface of the drum hoop.

As is shown in FIG. 4, there is a tapered surface 19 on the inner peripheral surface 18 of the hoop 11. The surface 19 is like a groove located on the inner peripheral surface of the hoop 11 on the side thereof toward the floor such that the bottom of the groove becomes gradually lower because the inner surface of the hoop tapers toward the outer surface of the hoop from the axially outer edge facing away from the drum body toward the axially inner edge 16B of the hoop, i.e., the edge away from the clamp 40 and toward the drum body. The tapered inner surface 19 may be provided not only on the part engaged by the hoop clamp 40, as shown in FIG. 4, but also on the entire inner peripheral surface of the hoop 11. The tapered surface 19 permits installation of a hoop clamp 40 of the drum pedal 30 to the hoop 10 for the bass drum in a simple and accurate manner.

The hoop for the bass drum according to the invention may be formed from metal pressing or die casting or may be injection molded into a prescribed shape from plastic. In the latter case, a suitable reenforcing rib may be used. If the hoop is made of plastic, the weight of the bass drum is reduced, making it easier to carry.

Since the lug bolt receiver with a lug bolt insertion hole is formed on the outer periphery of the 10 hoop, there is no possibility that the lug bolt receiver will drop off the hoop during attachment or detachment of the hoop, e.g., during an exchange or replacement of a drum head, thereby facilitating exchanging of the drum head or the assembly of the drum in an accurate manner.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A hoop for a bass drum, wherein the bass drum comprises a drum body with an open end, a drum head over the open end and a hoop around the drum body generally at the open end for engaging the drum head and holding the drum head over the open end of the drum body;

a plurality of lugs arrayed around the drum body for receiving lug bolts and a respective plurality of lug bolts to be tightened into the lugs;

the hoop comprising a respective lug bolt receiver formed on the hoop for each of the lug bolts at each of the lugs, the receiver including a hole passing through the hoop through which the lug bolt is passed to the lug, and the lug bolt and the hoop having means thereon for holding the lug bolt to the hoop as the lug bolt passes through the hole in the bolt receiver and is tightened into the lug; and having an outer edge away from the drum body and an inner edge toward the drum body, the hoop having an inner peripheral surface toward the drum body and an outer peripheral surface away from the drum body and the inner surface being tapered gradually toward the outer surface moving from the outer to the inner edge of the drum hoop.

2. The drum hoop of claim 1, wherein the hoop has an outer peripheral surface around the drum body and the lug bolt receiver in part extends inside the outer peripheral surface of the hoop.

3. The drum hoop of claim 2, wherein the means for holding the lug bolt to the hoop comprises the lug bolt having a head for being held at the hoop;

the outer peripheral surface of the hoop having an outer edge and the hoop and the lug bolt receiver thereon being so shaped as to define a space for the head of the lug bolt between the bolt receiver and the outer edge of the outer peripheral surface of the hoop.

4. The drum hoop of claim 1, wherein the hole in the receiver is sized so that at least part of the hole is the size of the lug bolt passing therethrough, and the lug bolt has a head thereon which engages and is supported on the hoop for holding the lug bolt to the hoop as the lug bolt is tightened into the respective lug.

* * * * *